United States Patent [19]

Hupp et al.

[11] 4,023,295

[45] May 17, 1977

[54] FIREARM CONSTRUCTION HAVING MECHANICAL MEANS FOR THE EJECTION OF MISFIRED CARTRIDGES

[75] Inventors: Gerhard Hupp, Oberndorf (Neckar); Helmut Mäder, Schramberg, both of Germany

[73] Assignee: Industrie werke Karlsruhe-Augsburg Aktiengesellschaft, Germany

[22] Filed: Feb. 20, 1975

[21] Appl. No.: 551,085

[30] Foreign Application Priority Data

Feb. 21, 1974 Germany ..... 2408396

[52] U.S. Cl. ..... 42/25; 42/15

[51] Int. Cl.[2] ..... F41C 15/02

[58] Field of Search ..... 42/25, 26, 27, 15, 39.5; 89/26

[56] References Cited

UNITED STATES PATENTS

| | | | |
|---|---|---|---|
| 2,940,201 | 6/1960 | Reed | 42/25 X |
| 3,474,560 | 10/1969 | Ramsay | 42/15 X |
| 3,628,277 | 12/1971 | Plumer et al. | 42/25 |
| 3,641,692 | 2/1972 | Wells | 42/25 |
| 3,667,147 | 6/1972 | Goldin et al. | 42/15 |
| 3,889,572 | 6/1975 | Vorgrimler et al. | 42/25 X |

*Primary Examiner*—David H. Brown
*Attorney, Agent, or Firm*—McGlew and Tuttle

[57] ABSTRACT

A firearm, comprises a gun housing having a side opening and a gun barrel supported in the housing with a projectile bore which is alignable with a cartridge chamber of a cartridge holder. The cartridge holder is mounted on a bearing member which is journaled in the housing at a position overlying the barrel. A charge handle projects out of the housing and it is guided on the bearing member and is movable relative to the bearing member to cause rotation of the bearing member with the cartridge holder in order to project the cartridge chamber out of the side opening of the housing to a cartridge ejection and loading position. In the cartridge ejection and loading position, an injector pin, which is under the force of a compression spring, is actuated to drive an ejector pin through the chamber and eject any cartridge which may still remain in the chamber as a result of a misfire. The return movement of the charge handle under an action of a compression spring causes return of the cartridge holder, with a new cartridge positioned in the chamber, and it also effects the loading of the ejector pin for the next operation.

7 Claims, 2 Drawing Figures

I
I
15
4
3
3a
2
2a
13
10
1a
1
5
7
7a
20
6
8
11
6a
12
II

I
6
13
14
12
2
13a
60°
I
2
4
10
II

FIREARM CONSTRUCTION HAVING MECHANICAL MEANS FOR THE EJECTION OF MISFIRED CARTRIDGES

FIELD AND BACKGROUND OF THE INVENTION

This invention relates in general to the construction of firearms and, in particular, to a new and useful short small firearm intended for firing alternatively caseless ammunition and ammunition suitable for the ignition of rifle grenades or the like, and which includes mechanical means corresponding to these two types of ammunition for ejecting misfired cartridges.

DESCRIPTION OF THE PRIOR ART

Modern small arms which are used by military forces are subject to exacting and many requirements. Some of these requirements arise in view of the number of tactical demands of combat, such as demands for high firing power, high initial velocity, simplicity of handling, ruggedness, relatively small weight, extreme insensitiveness to high and low temperatures, and other weather condition extremes, etc., which are only a few of the requirements which are sometimes even contrary in nature.

A more general requirement, which is not minor from the point of view of combat tactics, is the possibility of using caseless ammunition in the weapon as well as using small arms for the throwing of rifle grenades. Caseless ammunition has the advantage of giving the user the possibility of carrying a conderably larger quantity of ammunition on the combat field because of the lighter weight over conventional ammunition in which the cartridges comprise cases and projectiles. This enables the user to operate for long periods of time without worrying about being supplied with additional ammunition.

The requirement of being able to fire rifle grenades as well, by means of a small arm, is a requirement which has been known for a long time, and it has been solved by many variations of construction, some of which entail further problems in design. As a rule, a specially constructed cartridge is needed for the firing of rifle grenades.

The adaptation of one and the same arm to use caseless ammunition and a special cartridge for the firing of rifle grenades poses technical and operational problems. That is, primarily, caseless ammunition, which is usually received in magazines, also involves misfires which must be taken into account and, in addition, small arms for firing such ammunition are normally not designed for a discharge of a rifle grenade.

SUMMARY OF THE INVENTION

The invention provides a firearm, particularly a short, small arm, which permits firing of both grenades and caseless ammunition. In accordance with the invention, a cartridge holder is mounted on a bearing tube which is carried in the housing above the rifle barrel and it may be swung between a position in which the cartridge chamber is aligned with the barrel bore outwardly from the housing to a position in which the cartridge, if it misfires, may be ejected or a new cartridge inserted. The construction includes an ejector pin at the injection location of the cartridge chamber which is actuated by movement of a charge handle and the positioning of the cartridge chamber in alignment therewith to force an ejector pin through the cartridge chamber and clear the bore as soon as the cartridge chamber reaches its extreme swung-out position. With the charge handle held so that the cartridge chamber is in its extended position, a cartridge suitable for the ignition of a rifle grenade can be inserted into the cartridge chamber before it is permitted to return by release of the charge handle.

According to a development of the invention, the pivotal movement of the cartridge chamber is effected by means of a cam surface provided in a bearing tube which is mounted parallel to the gun barrel and which provides the rotational axis for the movement of the cartridge holder. A drive pin carried on the charge handle is guided during the movement of the charge handle in a cam groove of the bearing tube so as to effect rotation thereof along with the cartridge holder.

The invention also provides a construction of ejector pin which is located in alignment with the swung-out position of the cartridge chamber and which is biased by a compression spring so that it may be released for movement through the cartridge chamber when it is in an extended position but which is protected or covered by a spring-loaded lid when the cartridge chamber is returned. The inventive arrangement is such that the opening and closing of the cover lid for the side of the housing operates in synchronism with the swinging in and out of the cartridge chamber by actuation of the charge handle.

The invention has several advantages:

Due to the ingenious connection of the charge handle with the spring-loaded ejector pin, the swinging of the cartridge chamber out of the longitudinal axis of the arm which is positively effected by the actuation of the charge handle and also the positively effected engagement of the ejector pin into the caliber bore of the cartridge chamber while the latter is swung out into its extreme position and the further action of the ejection of the misfired cartridge, if there is one, facilitates the handling of such a small arm by the user. It is evident that a safe and, in particular, rapid removal of a misfired cartridge through a simple actuation of a charge handle is of extraordinary importance in combat areas where the arm must be ready again as soon as possible.

Since, in normal cases, a special ammunition is needed for the firing of rifle grenades, the invention is instrumental in a most suitable manner in that no constructional adaptation whatsoever is necessary and the cartridge for firing a rifle grenade can be inserted into the swung-out cartridge chamber merely upon actuation and manual retention in its rear position of the charge handle. Thereby, the desired versatility in service of the firearm is increased to a notable degree.

Accordingly, it is an object of the invention to provide a firearm which includes a cartridge holder pivotally mounted on a bearing member so that the cartridge chamber may be aligned with the bore of the gun barrel or moved outwardly by the actuation of a charge handle to an ejection and loading position and which includes ejection means at the position to enter into the cartridge chamber and remove a cartridge therefrom, should there be one in the event of a misfire.

A further object of the invention is to provide a small firearm which includes a laterally movable cartridge holder which moves out of a gun housing side opening for ejection and loading cartridges and which may be used with both caseless ammunition and rifle grenades.

A further object of the invention is to provide a firearm which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

DESCRIPTION OF THE PREFERRED EMBODIMENT

Figure 1:
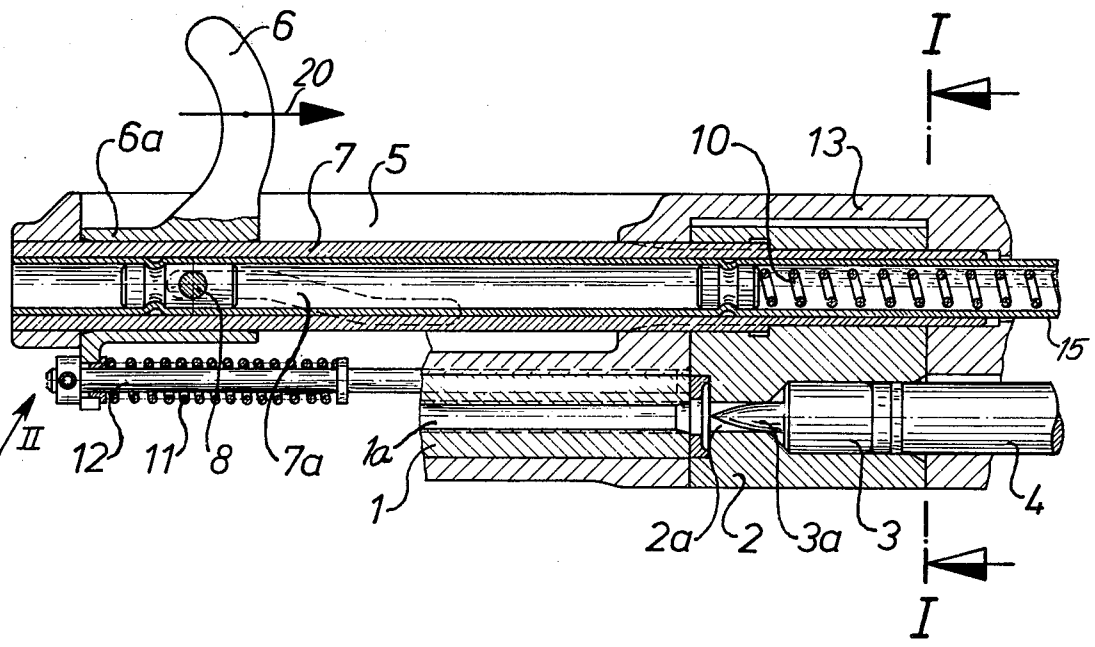
FIG. 1 is a partial axial sectional view of a firearm constructed in accordance with the inventin and taken partly along the line I—I and partly along the line II—II of FIG. 2.

Referring to the drawing in particular, the invention embodied therein, comprises a small short firearm which includes a housing 13 which at least partially encloses the rear end of a gun barrel 1 having a gun barrel projectile bore 1*a* which, in the firing position, aligns with a cartridge chamber 2*a* of a cartridge holder 2. FIG. 1 shows the forward portion which is taken along line I—I and the rear portion rotated to the position shown in FIG. 2 in dotted lines and taken along line II—II of FIG. 1.

In accordance with the invention, a bearing member, in the form of a bearing tube 7, is mounted in the housing above gun barrel 1 and is parallel thereto. The cartridge holder 2 is mounted on bearing tube 7 and is rotatable therewith when it is rotated by movement of a charge handle 6 in the direction of the arrow 20. The charge handle 6 rides in a slot 5 of the housing 13. Cartridge chamber 2*a* includes a widened portion, so that it is capable of holding a projectile tip 3*a* and a widened body of a caseless ammunition 3. In the firing position, a firing pin mechanism 4 is alignable with the cartridge chamber 2*a* to effect the firing thereof. Instead of the mechanical device 4, it is also possible to use an electrical or electronic ignition device.

In accordance with a feature of the invention, the charge handle 6 is provided with a sleeve portion or bushing 6*a* which engages around the bearing member 7 and it includes a pin 8 which rides in a groove 7*a* thereof defining handle-guiding cam means. Rearward movement of the charge handle 6 is effected against the force of a compression spring 10 and the pin 8, riding in a cam groove 7*a* of bearing tube 7, causes rotation of the tube along with the cartridge holder 2 to move it from the solid line position shown in FIG. 2 to the dotted line position, in which the holder tube bears against a pivotal lid 14 to move it to an open position at which the holder 2 at least partly extends outside of the housing. Housing 13 is provided with a slot 13*a* of a size to permit movement of the cartridge holder 2 outwardly as indicated. The outward position corresponds to a cartridge ejection and loading position.

Figure 2:
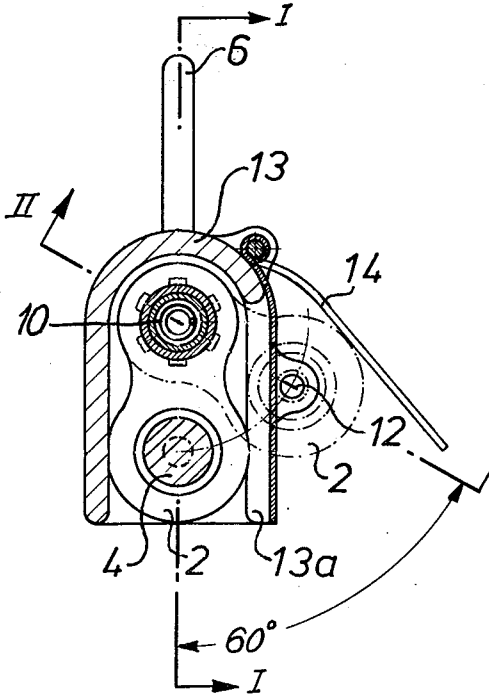
FIG. 2 is a vertical section taken along the line I—I of FIG. 1.

Cartridge ejection is necessary in the event that a cartridge misfires and, in such case, a movement backwardly of the charge handle 6 in the direction of arrow 20 to present the cartridge holder in the outer position indicated in dotted lines in FIG. 2 causes a triggering of an ejection pin mechanism, which includes an ejector pin 12 which is biased by a compression spring 11 to an ejection position in which it extends backwardly far enough to move into cartridge chamber 2*a* and move a projectile therein out of the chamber. Ejector pin 12 can only be moved by compression spring 11 when holder 2 is in the outer position and a closure lid 14 is removed so that compression spring 11 may drive the pin through cartridge chamber 2*a*.

The bushing 6*a* carries pin 8 so that it extnds transversely to the longitudinal axis of the firearm and is guided in groove 7*a*. When cartridge chamber 2 has reached its maximum swung out position, as shown in dotted lines in FIG. 2, the ejector pin 12, under the action of spring 11, is driven into the caliber bore portion of cartridge chamber 2*a* and acts through the nose 3*a* of the projectile to impart a rearward motion to cartridge 3 to eject it from the chamber. Since this ejection operation is synchronous with the motion of charge handle 6 in the direction of the arrow 20, the cartridge chamber 2 will be returned upon the backward movement of charge handle 6. At the same time, the next cartridge is moved from a magazine (not shown) into the cartridge chamber 2*a* so that, within a few seconds, the arm is ready for firing again.

When charge handle 6 is moved all the way backwardly to position the cartridge chamber 2 in the ejection and loading position, the chamber may be held in that position until a new cartridge is inserted, for example, one which is suitable for firing of a rifle grenade. The compression spring 10 returns the charge handle 6 into its forward position and this action also returns cartridge chamber 2 to its ready position in which it is entirely within housing 13 with cartridge chambe 2*a* aligned with barrel bore 1*a* in a position ready for firing a rifle grenade. During the return position, lid 14 is swung backwardly under the force of a spring (not shown) so that it again closes the slot 13*a*.

While a specific embodiment of the invention has been shown and described in detail to illustrate the application of the principles of the invention, it will be understood that the invention may be embodied otherwise without departing from such principles.

What is claimed is:

1. A firearm, comprising a gun housing having a side opening, a gun barrel in said housing having a barrel projectile bore, a bearing member rotatably journaled in said housing at a location overlying said barrel, a cartridge holder aligned with the side opening of said housing and connected to said bearing member for rotation therewith and having at least one cartridge chamber alignable with the barrel projectile bore in one position thereof, a charge handle movable backwardly and forwardly on said bearing member and having a hand engageable portion projecting out of said housing, cam means connected between said handle and said bearing member to cause rotation of said bearing member with said cartridge holder around the axis of said bearing member to shift said cartridge holder outwardly of said housing to a cartridge ejection and loading position during movement of said handle, and ejector pin means mounted on said housing in a position aligned with the cartridge chamber when it is in an ejection and loading position for ejecting a cartridge therefrom.

2. A firearm according to claim 1, including a lid closing said side opening and being pivotable on said housing to permit it to be opened by the contact with said cartridge holder.

3. A firearm according to claim 1, wherein said gun housing has a side wall with a slot forming the side opening alongside said cartridge holder, a cover lid pivoted on said housing and closing the slot opening, said charge handle being movable to rotate said bearing member to displace said cartridge holder against said lid and to open said lid during movement of said cartridge holder to said ejection and loading position.

4. A firearm according to claim 1, wherein said ejector pin means comprises a mounting bracket, an ejector pin axially displaceably removable on said mounting bracket, spring means biasing said pin in a direction toward said cartridge holder, said charge holder being effective by movement to release said spring to move said ejector pin to enter the cartridge chamber when said cartridge holder is positioned in an ejection and loading position.

5. A firearm according to claim 1, including a return spring biased against said handle, said cam means including a cam groove defined along said bearing member, said charge handle including a bushing surrounding said bearing member and having a pin extending transversely therethrough engaged in said cam groove and effective to rotate said bearing member relative to said bushing to effect displacement of said cartridge holder.

6. A firearm according to claim 1, including a cam pin carried by said charge handle, said bearing member comprising a tube having an axially adjacent cam groove into which said pin projects, said pin and said cam groove comprising said cam means.

7. A firearm according to claim 6, wherein said pin extends transversely to the longitudinal axis of said bearing member and said firearm.

* * * * *